US006341817B1

(12) United States Patent
Stern-Gonzalez

(10) Patent No.: US 6,341,817 B1
(45) Date of Patent: Jan. 29, 2002

(54) CONVENTIONAL COOLER WITH RECLINABLE SEAT BACK AND SEAT

(76) Inventor: Edgar Stern-Gonzalez, Ricardo Margain Zozaya 171 Norte Colonia Santa Engracia, 66267 San Pedro Garza Garcia, Nuevo Leon (MX)

( * ) Notice: Subject to any disclaimer, the term of this patent is extended or adjusted under 35 U.S.C. 154(b) by 0 days.

(21) Appl. No.: 09/487,617

(22) Filed: Jan. 20, 2000

(30) Foreign Application Priority Data

Oct. 19, 1999 (MX) ..... 99-9601

(51) Int. Cl.[7] ..... A47C 7/62

(52) U.S. Cl. ..... 297/188.1; 297/188.09; 297/377

(58) Field of Search ..... 297/188.1, 188.01, 297/188.09, 188.13, 380, 377

(56) References Cited

U.S. PATENT DOCUMENTS 3,877,750 A * 4/1975 Scholpp ..... 297/377 X
5,451,092 A * 9/1995 Gray ..... 297/188.13 X
5,660,296 A * 8/1997 Greenwich ..... 297/188.08
5,727,844 A * 3/1998 O'Quinn et al. .... 297/188.09 X
5,779,314 A * 7/1998 Grace ..... 297/377 X
6,000,752 A * 12/1999 Shyr ..... 297/188.08
6,007,572 A * 12/1999 Baldwin ..... 297/380 X

* cited by examiner

*Primary Examiner*—Laurie K. Cranmer
(74) *Attorney, Agent, or Firm*—Crowell & Moring LLP

(57) ABSTRACT

A cooler is provided with an integrated seat and a reclinable seat back formed by one cover used to close the cooler. Drinks and foods may be stored and maintain fresh and cool in the cooler. On top of the cover, a second cover is provided, which becomes the upper cover of a conventional cooler. The first cover that is used to close the cooler serves also as the seat when closed. The upper or second cover of the cooler serves as the seat back when opened at a 90 degree angle or higher. Two leashes, one on each side, maintain the seat back in the desired position. Such seat back can vary from 0 to 180 degrees. When opened at a greater angle than 130 degrees, the seat back is supported by a pair of legs located on the external surface of the second cover of the cooler, attached by one of their ends to such cover but free on the other end and attached only by pressure to such cover. The legs are capable of opening to a 90 degree angle with respect to their original position. A cushion may be placed on top of the seat and against the seat back so the cooler may have a cushioned seat and reclinable seat back for better comfort. The movement of the two covers are triggered by two pairs of hinges, each pair being independent from one another.

12 Claims, 6 Drawing Sheets

CONVENTIONAL COOLER WITH RECLINABLE SEAT BACK AND SEAT

BACKGROUND AND SUMMARY OF THE INVENTION

The present invention is related to coolers whose main purpose consists in maintaining and keeping foods and beverages fresh and cool, while taking advantage of the cooler's structure and material to provide a seating function.

The conventional coolers known in the market for maintaining and conserving drinks and foods fresh and cool are made of different materials and shapes. These coolers are well known and described in the field, most commonly made of hard plastic or any other insulated material being in a square or rectangular shape similar to a box, varying in size. It is composed of six sides: top side; bottom side; back side; front side; transversal left side; transversal right side. Generally, the top side is the cover of the cooler.

Some coolers are opened by completely removing the cover, and these are mostly made of polyurethane, their capacity is reduced and they are not very resistant. Bigger models, however, are made of hard plastic or any other resistant material with more capacity on the inside, but still being portable and comfortable to use in a picnic or any other similar activity for the storage and conservation of fresh foods and drinks. These models are opened by lifting the top side backwards in a 90 degree angle. The cover or top side is sustained and attached together at the top of the back side with hinges (similar to a common door).

Therefore, existing coolers only accomplish their described function, becoming just another accessory of the user. It has been observed, however, that people sometimes use common coolers as seats or tables; but since the purpose and fabrication of such coolers are not intended for these services, the users do not obtain the comfort desired.

Therefore, the purpose of the present invention consists in satisfying the necessities of the users allowing them to have a cooler that could be used also as a seat, as well as a table or bunk, without any risk to the user or the cooler concerning comfort and stability. Specifically, the present invention has the following objectives:

1.—One objective of the invention consists in providing a cooler with a seat and a reclinable seat back.

2.—Another objective of the invention consists in providing a cooler with a seat and seat back on the top side of the cooler.

3.—Another objective of the invention consists in providing a cooler with a seat and reclinable seat back, which can be positioned at different inclination angles in accordance with the user's comfort.

4.—Another objective of the invention consists in providing a cooler with a seat and reclinable seat back putting on top of the seat and against the seat back a cushion or a similar material for a better comfort for the user.

5.—An additional objective of the invention consists in providing a cooler with a seat and reclinable seat back which can be positioned at a 180 degree angle to obtain a table or bunk where the user may lay down.

6.—Another objective of the invention consists in providing a cooler with a seat and reclinable seat back, which, when positioned at 130 degree angle or higher, it can be sustained by legs.

Other objects, advantages and novel features of the present invention will become apparent from the following detailed description of the invention when considered in conjunction with the accompanying drawings.

DETAILED DESCRIPTION OF THE DRAWINGS

The purpose of the common cooler consists in maintaining and keeping drinks and foods fresh and cool.

It is the intention of the present invention to provide not only a cooler to be used for keeping and maintaining drinks and foods fresh and cool, but also to provide the user with a seat and seat back or a table to be used by the user either to rest or simply to place articles on it that otherwise could not be placed on the ground, without affecting the normal use of the cooler. This invention characterizes itself by incorporating over the cover of the cooler, a second cover to be used as a reclinable seat back which could be opened up to 180 degrees with respect to the original position of the cover of the cooler. Therefore, the invention allows the user to comfortably sit down against the reclinable seat back, or to even lay down on top of the cooler with the seat back opened at a 180 degree angle while the cooler stays closed. The user may also use the invention as a table while opening the seat back at a 180 degree angle. The special characteristics of the present invention are detailed in the following description.

Figure 1:
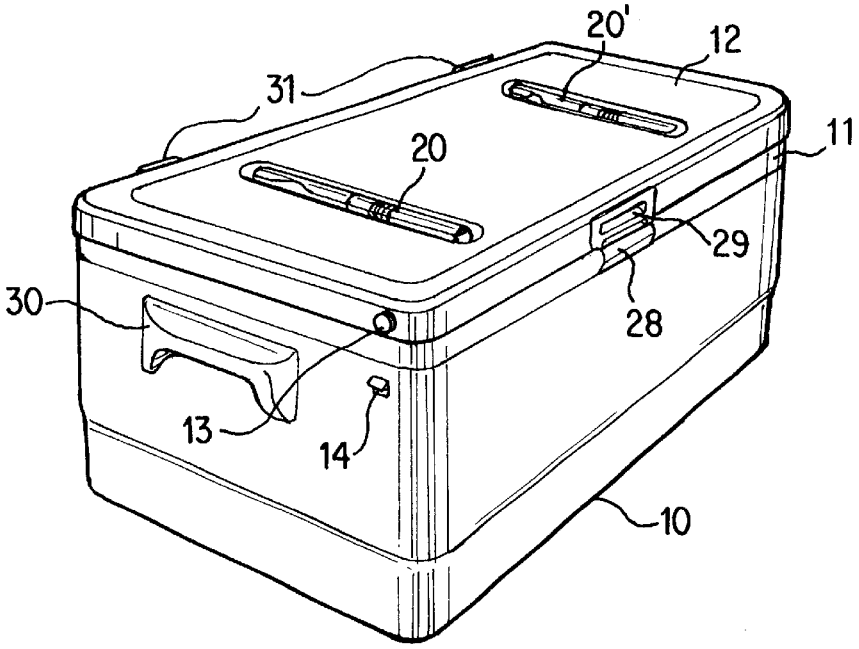
FIG. 1 is an aerial perspective view of the cooler with the cover and seat back of the cooler closed, showing the exterior parts.

FIG. 1 shows the cooler (10) closed from an aerial perspective view, showing also the cover or top side of the cooler (11), as well as the reclinable seat back (12), which is located on top of the cover (11) of the cooler (10). A couple of brooches (snaps, locks, etc.) are provided (13 and 14) in one of the lateral transversal sides of the cooler (10). It is important to mention that the lateral sides of the cooler (10) are symmetric, consequently both sides have identical brooches not shown due to the perspective of the figure. Nevertheless, for purposes of the present description it shall be interpreted that whatever is described for one of the transversal sides is present and shall apply for the other transversal side, even if not shown in the figure.

It is important to mention that both brooches (13 and 14) are located at an identical distance from the corner formed by the frontal and lateral side of the cooler (10), and the frontal and lateral sides from the reclinable seat back (12), such brooches may be located anywhere within the first third of the cooler's body (10), and more specifically close to the corner formed by the frontal and lateral side of the cooler (10) and the reclinable seat back (12), the exact distance depending upon the actual measurements of the cooler.

The aforementioned brooches are located such that one (14) is in the lateral side of the cooler (10) and the other brooch (13) on the same side is located in the lateral side of the seat back (12). Both brooches (13 and 14) are located on the outside of the cooler, permitting the cover and the seat back to close hermetically and therefore allowing the inside contents to be maintained at a low temperature for a long time. The cooler lock or brooch can also be observed consisting of two pieces; the inferior piece (28) located on the body of the cooler (10) and the superior piece (29), located on the reclinable seat back (12) referred in the present application. Both pieces of such brooch or lock (28 and 29) are made of resistant plastic and operate to lock or close by pressure in a conventional manner known for a conventional cooler. On each of the transversal sides of the cooler (10), a handle or grip (30) is located of a conventional nature for conventional coolers. The back side of the cooler (25, FIGS. 10 and 11) is attached to the seat back (12) by two hinges (31) located on the exterior part of the cooler (10). When opening the seat back (12), the hinges (31) remain underneath the seat back (12). The present invention contains two more hinges described in FIG. 4.

Figure 2:
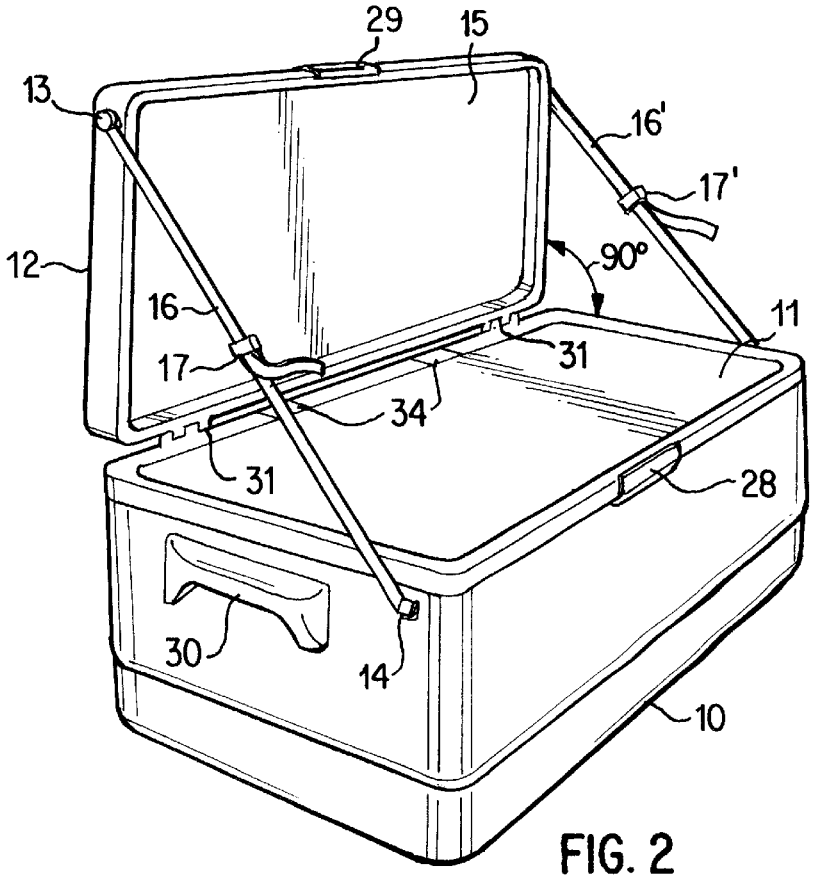
FIG. 2 is an aerial perspective view of the cooler with the cover of the cooler closed and the seat back of the invention opened at a 90 degree angle.

FIG. 2 shows an aerial perspective view of the cooler (10) with the cover (11) of the cooler closed and the seat back (12) opened at a 90 degree angle, where the brooches (13 and 14) are attached together by way of leashes (16 and 16'). Therefore, the seat back can be maintained at a 90 degree angle with respect to its position when closed. Each leash has an adjustment brooch (17 and 17') allowing the leashes (16 and 16') to be adjusted at different lengths, therefore permitting the seat back (12) to be positioned at different reclinable angles at the comfort of the user. The aforementioned numbers (16' and 17') referred to the leash and brooch respectively and are identical to the leash and brooch identified with the numbers (16 and 17), therefore it is considered that it is not necessary to mentioned both sides, under the understanding that what is applicable to parts 16 and 17 is valid and applicable to parts 16' and 17'.

The leashes (16 and 16') can be removed from the brooches (13, 14 and 13' and 14' (not shown)), to be stored inside the cooler or any other place if required.

Figure 3:
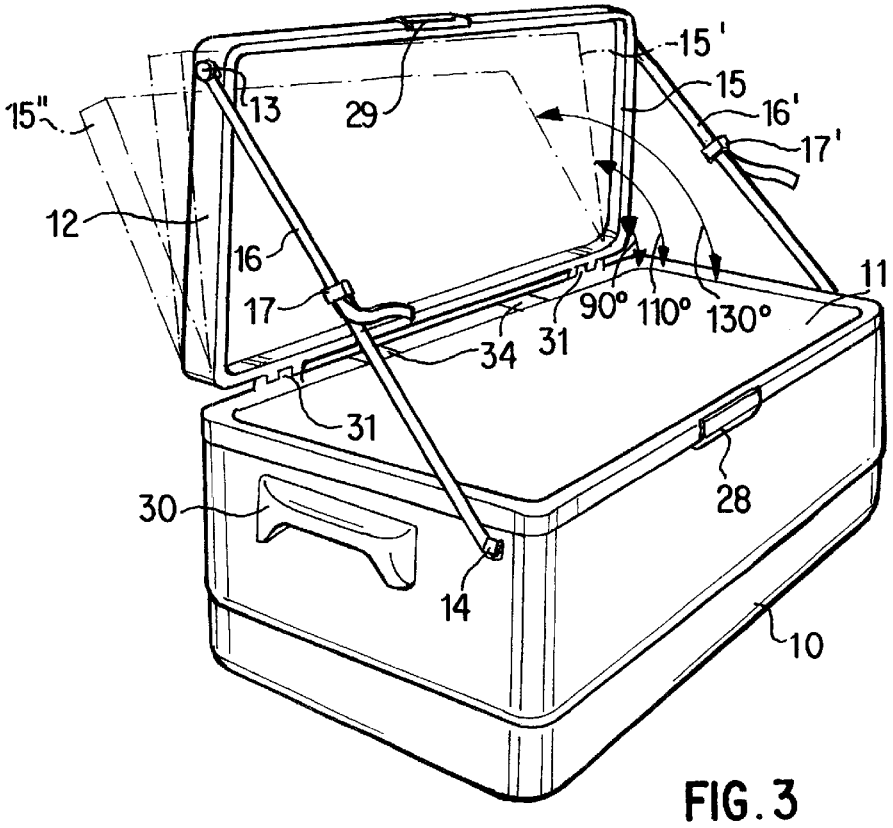
FIG. 3 is an aerial perspective view of the cooler with the cover of the cooler closed and the seat back opened at different opening positions of 90, 110 and 130 degrees.

FIG. 3 is an aerial perspective of the cooler (10), with the cover (11) closed and the seat back (12), opened at a 90 degree angle, showing an additional opening of a 110 and 130 degree angle. Even though FIG. 3 shows the seat back (12) positioned at three different angles, such seat back (12) may be positioned at every possible angle from 0 to 180 degrees just by adjusting the leashes (16 and 16') accordingly with the brooches (17 and 17'). The present figure shows the utility of the cover (11) of the cooler (10), in conjunction with the reclinable seat back (12) to form the seat for the user, or to use the cover (11) and the seat back (12) as a table.

Figure 4:
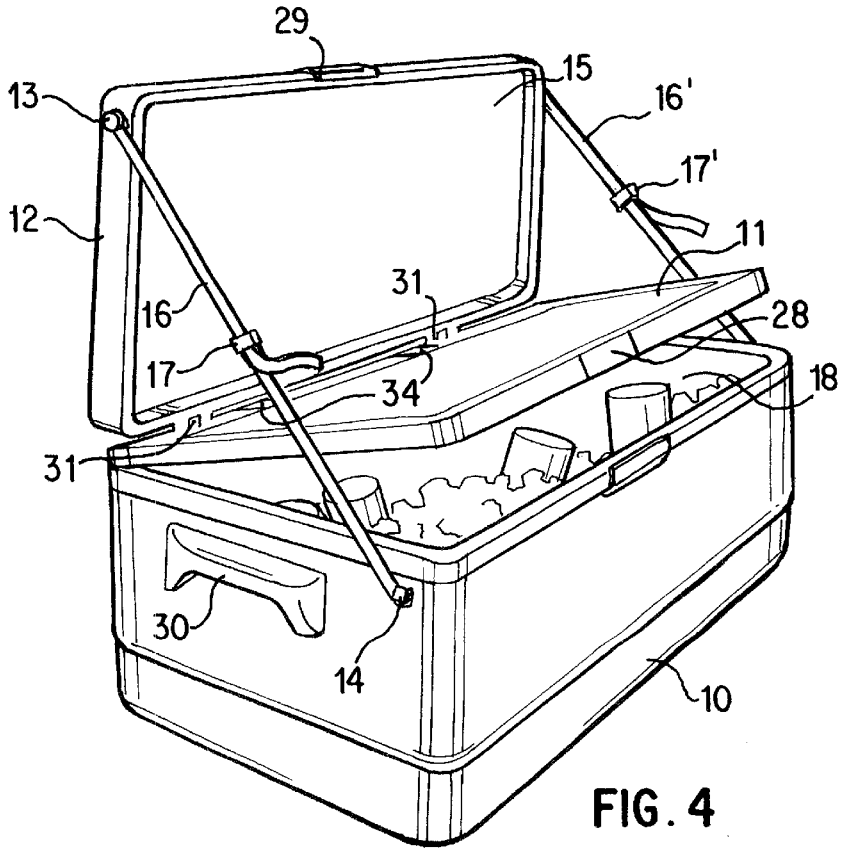
FIG. 4 is an aerial perspective view of the cooler with the cover of the cooler slightly opened, showing its contents, and with the seat back opened 90 degrees.

FIG. 4 is an aerial perspective view of the cooler (10) with the cover (11) opened at a 20 degree angle and with the seat back (12) opened at a 90 degree angle. It is not necessary to completely lift the cover (11) to take any of the contents (18) out of the cooler (10). The hinges (34 not shown in the figure) of the cover (11) of the cooler are completely independent from the hinges (31) of the seat back (12), allowing the cover (11) of the cooler (10) to be opened without affecting the position of the seat back (12). The hinges are composed of two pairs; the number 31 pair for the opening of the seat back (12) and the number 34 pair for the opening of the cover (11) of the cooler (10). The location of the hinges depends on the width of the cooler (10), however, they are positioned in such way that they are independent of each other, and as mentioned before, it is possible to open the cooler without affecting the seat back (12). The hinges are of a conventional type and are well known in the field, the preferred location for the hinges (31) being closer to the end of the cooler (10) than that of the other pair of hinges (34), allowing the two pair of hinges to work independently.

Figure 5:
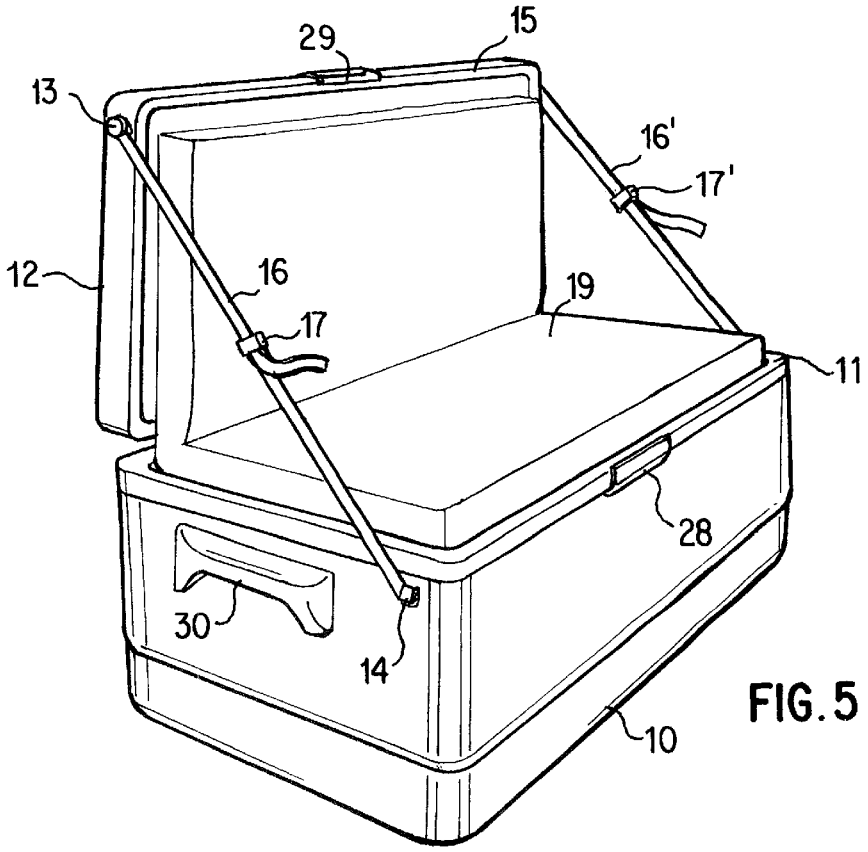
FIG. 5 is an aerial perspective view of the cooler with the cover of the cooler closed and the seat back opened at ay 90 degree angle, with a cushion being shown on top of the seat and against the seat back to make the seat and seat back more comfortable.

FIG. 5 is a preferred embodiment of the present invention, illustrating a perspective view of the cooler (10) with the cover (11) closed and the seat back (12) opened at a 90 degree angle. Placed over the cover (11) of the cooler (10) and leaning against the seat back (12) is a cushion (19) to make the seat more comfortable. The cushion (19) may also be removed from its position and stored away inside the cooler or any other storage place when not in use. The most comfortable position of the user to use the seat and reclinable seat back (12) is with the seat back (12) positioned at a 90 degree angle or higher. The integrated seat is formed by the top part of the cover (11) of the cooler (10).

Figure 6:
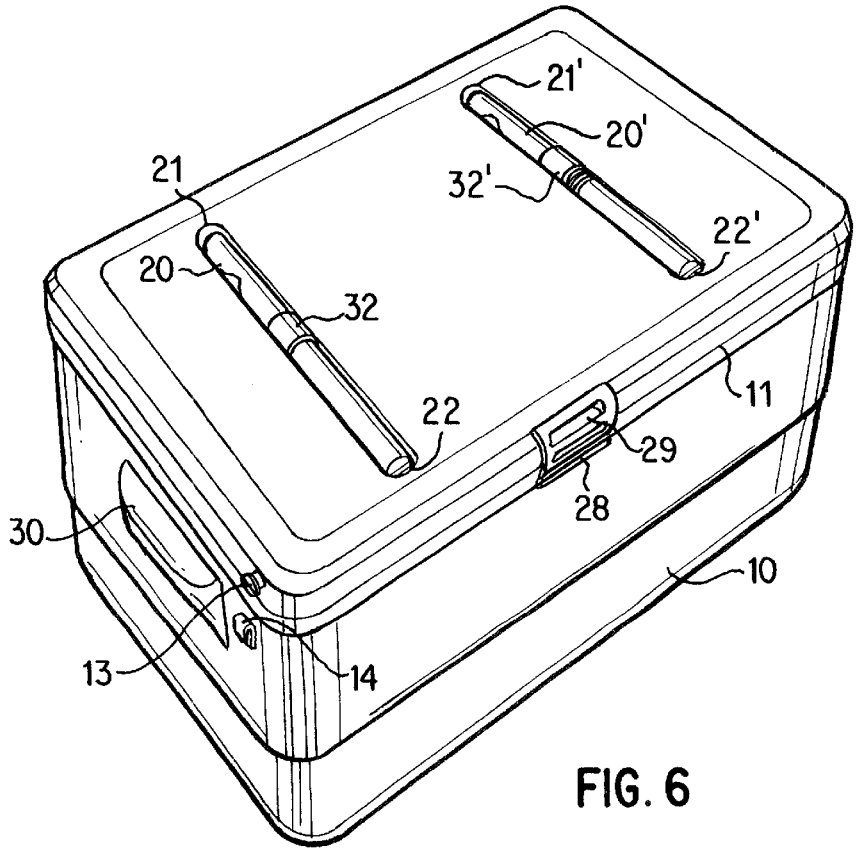
FIG. 6 is an aerial perspective view of the cooler with the cover and seat back closed, on the external side of such seat back two legs being shown in a closed position, which legs are used when the seat back is opened at more than a 130 degree angle.

FIG. 6 is an aerial perspective view of the cooler (10) with the cover (11) and the seat back (12) closed. On top of the external side of the seat back, a pair of legs (20 and 20') are shown in a closed position. The legs are used when the seat back (12) is opened at a 180 degree angle.

In a preferred embodiment of the present invention, the external side of the seat back (12) of the cooler (10) shows a pair of channels (21 and 21'), which are parallel to each other and perpendicular to the frontal and back sides of the cooler (10). In each of the channels (21 and 21'), a leg (20 and 20') is located. These legs are used to support the seat back (12) of the cooler (10) when opened more than 130 degrees. In the following, one leg shall be described and it shall be understood that they are symmetrical, i.e. what is being defined for one shall be the same for the other.

The left leg (20), with respect to the user if he is facing the cooler (10), is attached by one of its extremities (22) to the external side of the seat back (12) of the cooler (10) by any known means, for example a bolt transversal to the leg (20) of the cooler (10), but as long as it allows the leg (20) to rotate from 0 to 90 degrees. The leg (20) is attached to the external side of the seat back (12) of the cooler (10) at a frontal side of the seat back (12), and the other end of the leg (20) is provided with a particular form allowing the leg (20) to be attached to the external side of the seat back (12) of the cooler (10) by pressure.

The extremity of the leg (20) that is attached by pressure at the end of the channel (21) has enough space between the leg (20) and the channel (21) to allow the user to pull it out and place it into the desired position.

Figure 7:
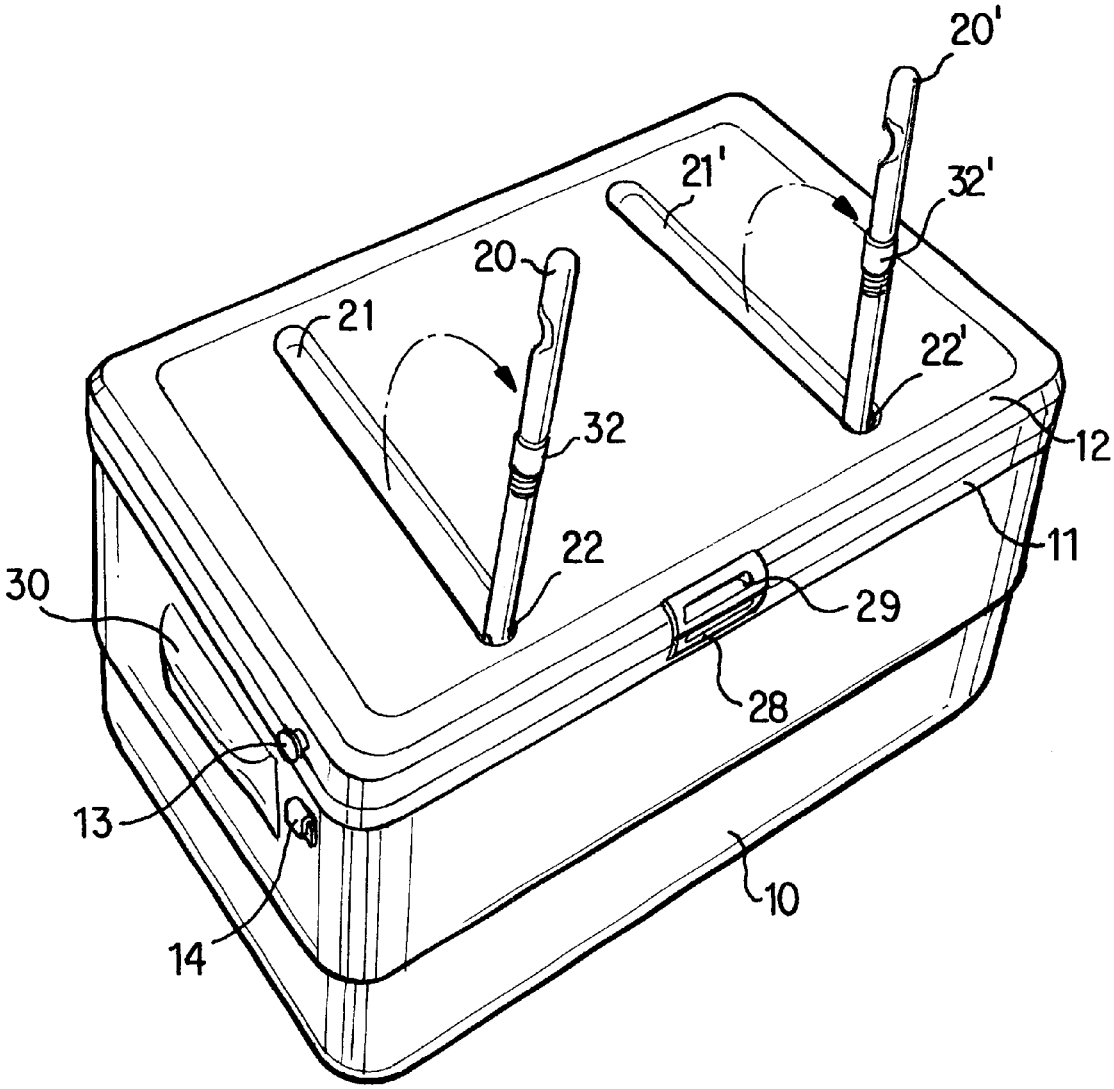
FIG. 7 is an aerial perspective view of the cooler with the cover and the seat back closed, where the legs of the seat back can be seen opened at a 90 degree angle.

FIG. 7 is an aerial perspective view of the cooler with the cover (11) and the seat back (12) closed, where the legs (20 and 20') of the seat back (12) are shown opened at a 90 degree angle.

Figure 8:
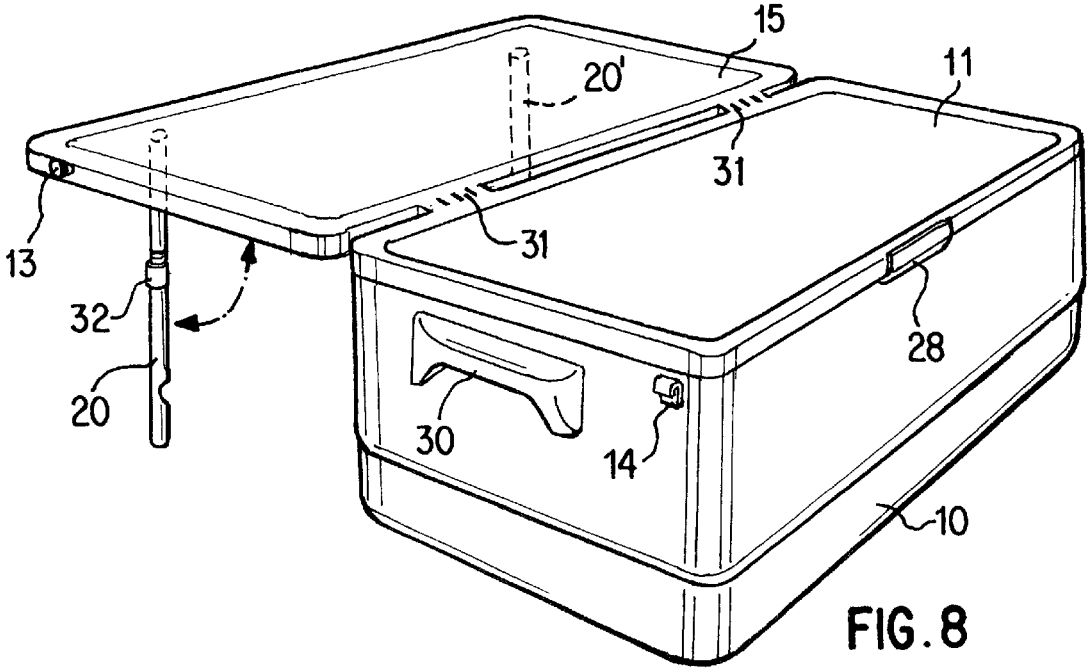
FIG. 8 is an aerial perspective view of the cooler with the cover closed and the seat back opened at a 180 degree angle, supported by the legs which are opened at a 90 degree angle.

FIG. 8 is an aerial perspective view of the cooler (10) with the cover (11) closed and the seat back (12) open at a 180 degree angle supported with the legs (20 and 20 ') opened at a 90 degree angle. This angle of the seat back (12) is the maximum opening capacity. In this position, the user may lay down comfortably or at least two persons may sit down. The hinges (31) of the seat back (12) (when opened) remain below such seat back (12) therefore, the user may lay down comfortably.

Figure 9A:
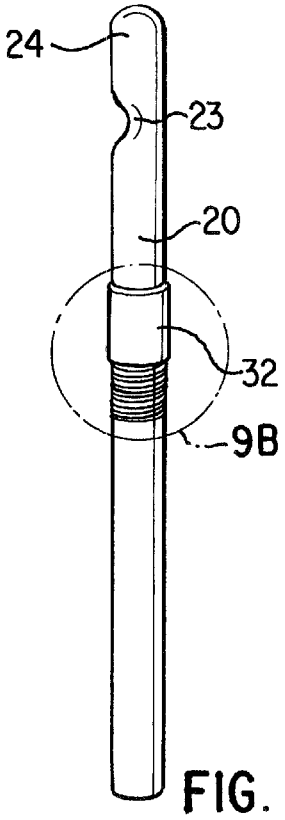
FIGS. 9A and 9B are perspective views of one of the legs located on the external side of the cooler, with the details of such leg being shown in FIG. 9B.
Figure 9B:
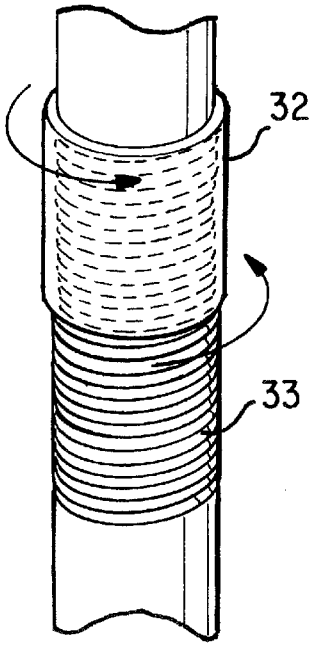

FIGS. 9A and 9B are perspective views of the legs (20 and 20') located on the external side of the seat back (12), one end of the legs (20 and 20') being attached at the external side of the seat back (12) to the channel (23) through a bolt or any other known means, and the other end of the legs (20 and 20') when opened or in use, being the end or extremity (24) that makes contact with the surface or ground.

The legs (20 and 20') are telescopic, therefore these may be extended at will through a simple mechanism consisting of the following. Each leg (20 and 20') is made of two pieces of the same size, the upper part of each leg (32 FIG. 9A), i.e., the part that is attached to the seat back (12), is hollow and threaded on the inside, similar to a bolt. The lower part of each leg (33) is not hollow and is threaded on the outside. Therefore, when the seat back (12) is opened at least to a 130 degree angle, the legs (20 and 20') can be extended at will to lean against the floor. As the seat back (12) opens to a greater angle than 130 degrees, the legs (20 and 20') may be contracted or shortened by introducing the lower piece (33 FIG. 9B) into the upper piece (32) by rotating them until the legs (20 and 20') reach the desired length and the seat back (12) reaches the desired reclinable angle. The length adjustment mechanism of the legs (20 and 20') is independent of each leg (20 and 20'). Therefore, each leg (20 and 20') can be adjusted to the required length and give the seat back (12) better stability.

Figure 10:
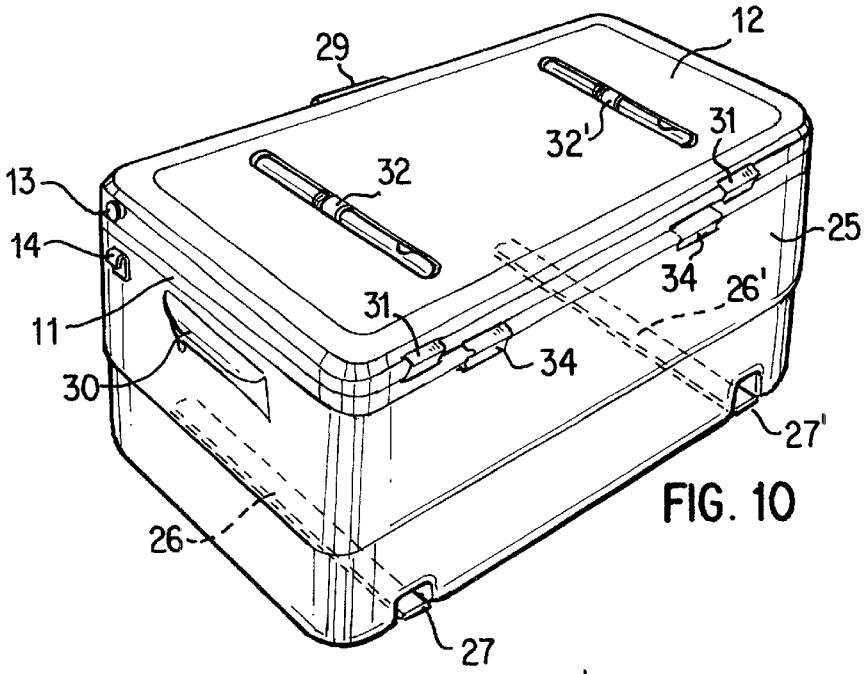
FIG. 10 is a ¾ aerial perspective view of the backside of the cooler with the cover of the cooler closed and the seat back closed, two rails and two sliding legs or extremities being shown on the bottom side of the cooler.

FIG. 10 is a ¾ perspective view of the back side of the cooler (10) with the cover (11) and the seat back (12) closed, showing two rails (26 and 26')) on the lower part of the cooler (10). These rails have two sliding legs (27 and 27') that slide through the rails (26 and 26').

Figure 11:
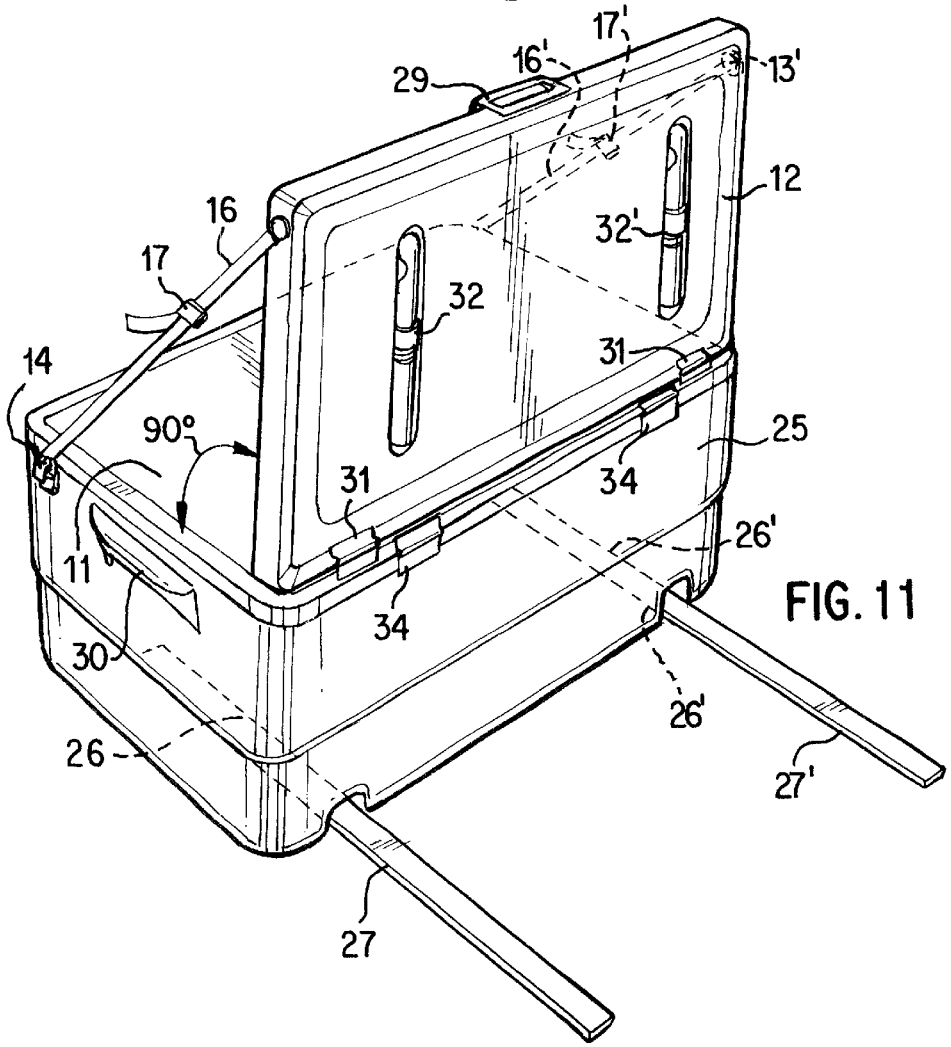
FIG. 11 is a ¾ aerial perspective view of the backside of the cooler with the cover of the cooler closed and the seat back opened at a 90 degree angle, showing the legs or extremities to have been slid out at the back of the cooler.

FIG. 11 is a ¾ perspective view of the back side of the cooler (10) with the cover (11) closed and the seat back (12) opened at a 90 degree angle, showing the two sliding legs (27 and 27') extended all the way to the back of the cooler (10) in order to provide better stability for the whole cooler (10) when the seat back (12) is opened or in use.

The preferred embodiment of the invention includes a cushion placed on the seat and against the seat back, as well as the legs employed when the seat back is opened at a 180 degree angle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cooler with integrated seat and seat back, comprising:

a top side, bottom side, frontal side, two lateral sides and a back side, said sides forming a cooler compartment;

wherein the top side is a cover comprised of a first cover and a second cover on top of the first cover, said second cover forming the seat back, and the first cover the seat; wherein the seat back is reclinable;

wherein on a surface of an external part of the cover of the cooler, two extendable legs are arranged, said legs being openable up to a 90 degree angle to support the cooler with the integrated seat and seat back when the seat back is opened at an angle between 130 and 180 degrees.

2. The cooler according to claim 1, further comprising leashes attaching the seat back to the cooler compartment, said leashes being adjustable in length.

3. A cooler with an integrated seat and seat back according to claim 2, wherein the leashes are attached on one side by a brooch located near a lateral external corner of the seat back and on the other side by a brooch located on at an upper transversal side of the cooler compartment, near a frontal side of said cooler.

4. A cooler with integrated seat and seat back according to claim wherein the leashes are removable from the brooches so as to be stored away when not in use.

5. A cooler with an integrated seat and seat back according to claim 1, wherein a pair of rails are arranged in the bottom side of the cooler, said rails each containing a single sliding leg.

6. A cooler with an integrated seat and seat back according to claim 5, wherein the sliding legs, which slide out and back on the bottom side of the cooler, provide support and stability to the cooler when extended out of the cooler when the seat back is opened and in use at any angle.

7. The cooler according to claim 1, further comprising a cushion arrangeable on top of the cover and against the seat back.

8. A multipurpose apparatus, comprising:

a cooler having a body portion, a bottom part and a top part;

said top part comprising first and second covers arranged one on top of the other, each of said covers being independently hinged to the body portion of the cooler;

said first cover functioning to close a cooler compartment of the cooler and to form, on an external surface, a seat;

said second cover opening in a reclinable manner up to 180 degrees to form a seat back on an inner surface thereof; and at least one extendable leg arranged in a closed position within the second cover, said leg pivoting into a support position up to a 90° angle with respect to a plane of said second cover to support the body portion of the cooler and seat back when the seat back is opened between 130 and 180 degrees.

9. The multipurpose apparatus according to claim 8, wherein said leg is held via a pressure restraint in the, closed position within said second cover when not used.

10. The multipurpose apparatus according to claim 9, further comprising:

at least one channel arranged in the bottom part of said cooler;

a slidable rail operatively arranged within said channel, said rail being slidable into an extended position outside of said cooler to support said seat back when in an operative position.

11. The multipurpose apparatus according to claim 8, further comprising:

at least one channel arranged in the bottom part of said cooler;

a slidable rail operatively arranged within said channel, said rail being slidable into an extended position outside of said cooler to support said seat back when in an operative position.

12. The multipurpose apparatus according to claim wherein said leg comprises first and second leg portions, said leg portions being adjustable relative to one another to extend or retract a longitudinal dimension of said leg.

* * * * *